United States Patent [19]

James

[11] 4,235,005

[45] Nov. 25, 1980

[54] APPARATUS FOR ASSEMBLING PALLETS

[75] Inventor: Raymond E. James, Chicago, Ill.

[73] Assignee: Palletron Incorporated, Schiller Park, Ill.

[21] Appl. No.: 11,204

[22] Filed: Feb. 12, 1979

[51] Int. Cl.[3] ..... B27M 3/00

[52] U.S. Cl. ..... 29/281.1; 29/432; 29/798; 227/41; 227/152; 269/41

[58] Field of Search ..... 29/432, 798, 281.1, 29/281.3; 227/41, 105, 106, 152, 154, 40, 44, 45; 269/321 F, 55–57, 13

[56] References Cited

U.S. PATENT DOCUMENTS

| | | | |
|---|---|---|---|
| 3,968,560 | 7/1976 | Vial | 227/45 X |
| 4,077,106 | 3/1978 | Lichtenstein | 227/152 X |

*Primary Examiner*—Carl E. Hall

*Attorney, Agent, or Firm*—Emrich, Root, Lee, Brown & Hill

[57] ABSTRACT

A cradle is mounted on a frame for pivotal movement about a horizontal axis between a start position and a discharge position. In the start position the pallet stringers are placed in the cradle and supported by upright guides including transverse, spaced guide bars. The stringers are clamped longitudinally. A first set of deck boards is placed across the stringers and fastened to them. The cradle is unlocked and rotated to the discharge position to thereby turn the partial pallet over. The other set of deck boards is then placed between longitudinal guide bars that had supported the stringers, and these deck boards are fastened to the stringers. The clamp is released, and the completed pallet falls under gravity free of the cradle which is then turned back to the start position for a new pallet.

7 Claims, 17 Drawing Figures

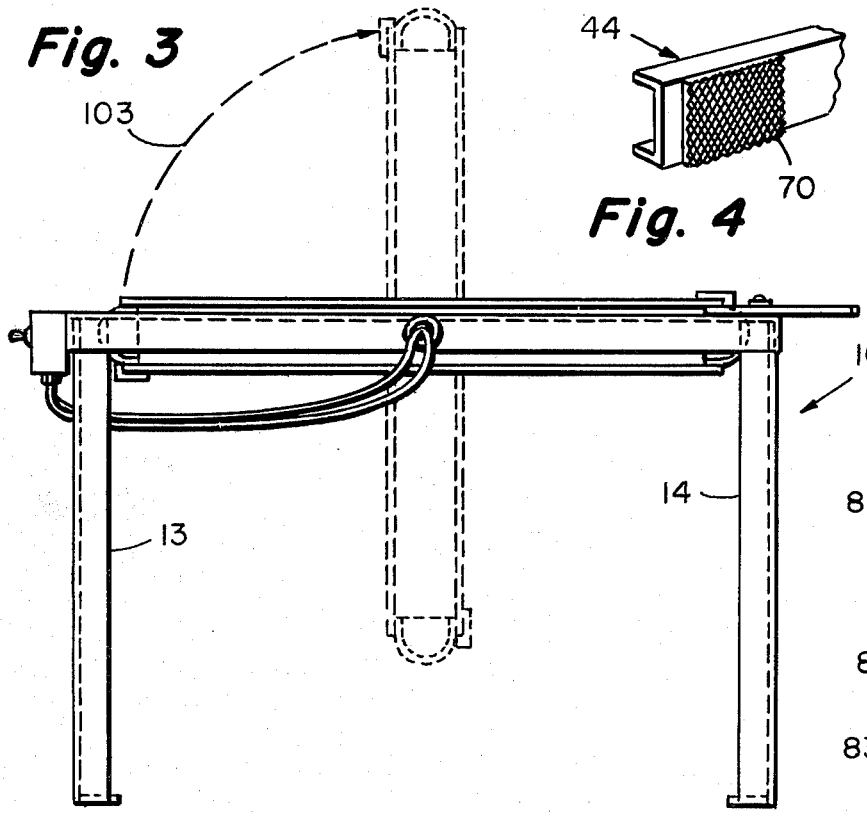
Fig. 3
Fig. 4
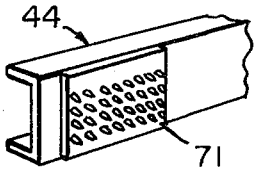
Fig. 5
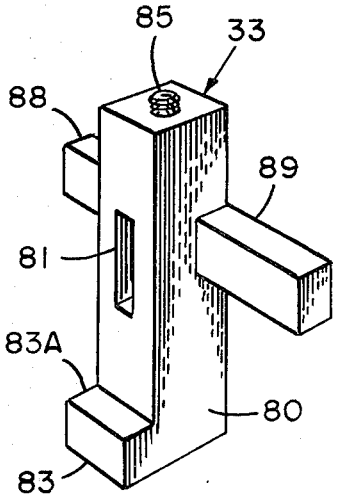
Fig. 10
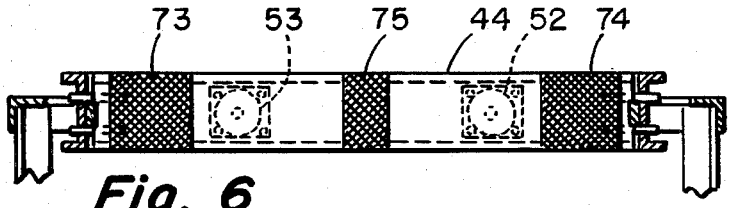
Fig. 6
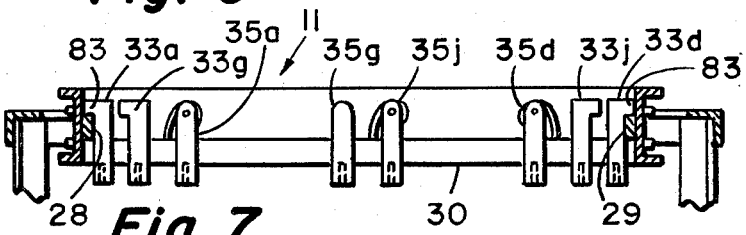
Fig. 7
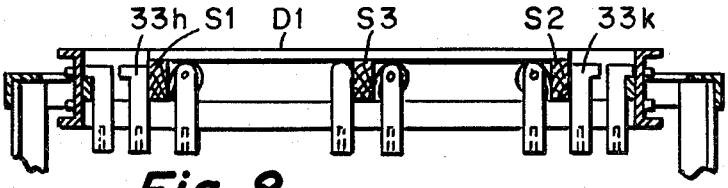
Fig. 8
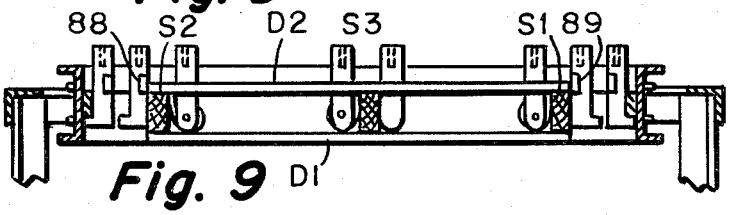
Fig. 9
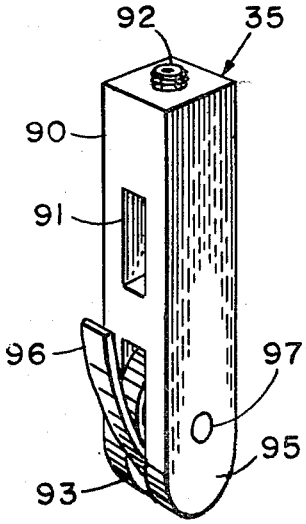
Fig. 11

APPARATUS FOR ASSEMBLING PALLETS

BACKGROUND AND SUMMARY

The present invention relates, in general, to material handling equipment and methods; and more particularly, it relates to apparatus and method for assembling wooden pallets of the type which are used for shipment and storage in many industries, such as the beverage industry, where goods are stored on a pallet and a load of goods is moved along with the pallet by means of a fork lift truck or the like.

Pallets are made in a variety of ways. Some of them are made completely by hand without even the simplest jigs or fixtures for assistance. Others are made by complex and very expensive machinery which not only feeds the deck boards into place, but automatically nails top and bottom deck boards in a single pass. Such machinery is obviously advantageous, but it is also so expensive that it is impossible to purchase for many manufacturers desiring to make pallets.

Pallets typically include three longitudinal members or "stringers." These are stronger members, typically made of 2×4 lumber. Two of them are located adjacent opposite edges of the finished pallet (they need not be flush), and the third is placed in the center. Upper and lower deck boards are fastened, preferably with nails, to the stringers. The deck boards extend transverse of the longitudinal direction of the stringers.

Pallets which are intended to be used in the heavier industries, such as automotive and the like, or in the beverage industry, are normally required to support heavy loads, and typically they are made of hard wood. Hence, an individual pallet which is 48"×48" may weigh as much as 100 pounds or more. Further, the pallet industry in the United States is characterized by many different sizes and designs for pallets.

The present invention, then, is directed to a machine which is both economical to make and easy to use in assembling pallets, and which combines the lower cost, reliability and accuracy of hand nailing with the advantages of machinery in supporting the components of the pallet during manufacture and discharging a pallet after completion in such a manner that the operator never has to lift a completed pallet.

Briefly, according to the present invention, a cradle is mounted on a frame for pivotal motion about a horizontal axis between a starting position (in which the top of the cradle extends in a horizontal plane) and a discharge position in which the cradle is rotated 180° about its rotational axis so that it is completely turned over.

The cradle includes a generally rectangular peripheral frame with a plurality of longitudinal guide bars extending between and supported by opposite ends of the peripheral frame. These bars extend in planes perpendicular to the axis of rotation of the cradle. At one end of the cradle, a linear actuator, such as an air cylinder is mounted between the peripheral frame and a clamping bar.

To commence operation, the clamping bar is retracted, and the cradle is placed in the start position. Stringers are placed in the cradle resting on the longitudinal guide bars and located by means of stringer guides carried by the guide bars. These stringer guides may be adjustably mounted to the guide bars so that pallets of different size or design may be accommodated by the apparatus.

After the stringers are inserted, the pneumatic cylinder is actuated (preferably, two such cylinders may be used) to clamp the stringers longitudinally. Means may be provided for locking the cradle relative to the frame at this time.

When the stringers are clamped in place, the operator places what will eventually be the bottom deck boards in their final positions across the stringers. These deck boards may be placed according to markings on the cradle. The bottom deck boards are then nailed to the stringers.

The cradle lock is then released, either pneumatically or manually, and the cradle is rotated 180° so that the bottom deck boards are now beneath the stringers. This is the discharge position. When the cradle is thus turned over, the guide bars which originally had supported the stringers are then above the stringers, and they act as guides for locating the center top deck boards. The top deck boards at the ends may be placed flush against the opposing stringer clamp surfaces. The cradle is, of course, latched in this position also.

The top deck boards are then nailed to the stringers, thereby finishing the pallet.

When the pallet is completed, the clamp is released and the pallet is discharged from the cradle under gravity, the top deck boards falling free of the longitudinal guide bars which originally supported the stringers. The pallet may be discharged onto a conveyor or other mechanism for transporting it to storage or to a stacking machine, if desired.

With the present invention, semi-skilled personnel can complete the assembly of a pallet in less than a minute using pneumatic hand nailers commercially available. In relation to the cost of the machine, this is a substantial advantage over other pallet machines commercially available, and certainly over complete hand assembly of pallets, even using pneumatic nail guns. Further, the apparatus does not require operating personnel ever to lift a completed pallet. This is a considerable advantage when it is considered that each pallet weighs over a hundred pounds and that over 450 pallets can be made in a single day.

As will be more fully understood from the following description, the apparatus is fully adjustable for pallets of different length and width, as well as different designs (that is, different numbers of top and bottom deck boards).

Other features and advantages of the present invention will be apparent to persons skilled in the art from the following detailed description of a preferred embodiment accompanied by the attached drawing wherein identical reference numerals will refer to like parts in the various views.

THE DRAWING

FIG. 3 is a left side view of the apparatus of FIG. 1 showing the cradle rotated 90° in phantom;

FIGS. 4 and 5 are fragmentary perspective views of a portion of the clamping bar;

FIGS. 6, 7 and 8 are transverse, fragmentary cross sectional views taken through the respective sight lines in FIGS. 1 and 2;

FIG. 9 is a view similar to FIG. 8 with the cradle turned over;

FIG. 10 is a perspective view of an adjustable end guide;

FIG. 11 is a perspective view of an adjustable stringer guide; and

DETAILED DESCRIPTION

Figure 1:
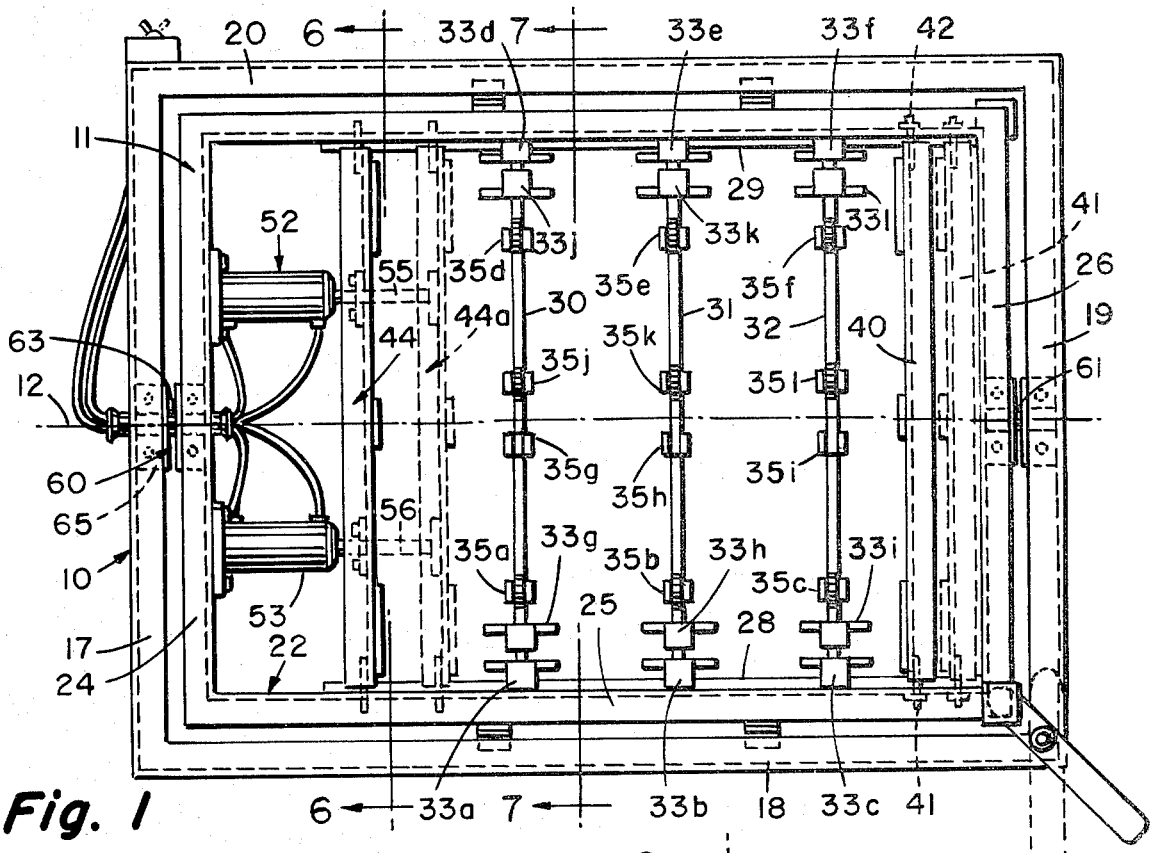
FIG. 1 is a plan view of apparatus constructed according to the present invention with the cradle in the start position.
Figure 2:
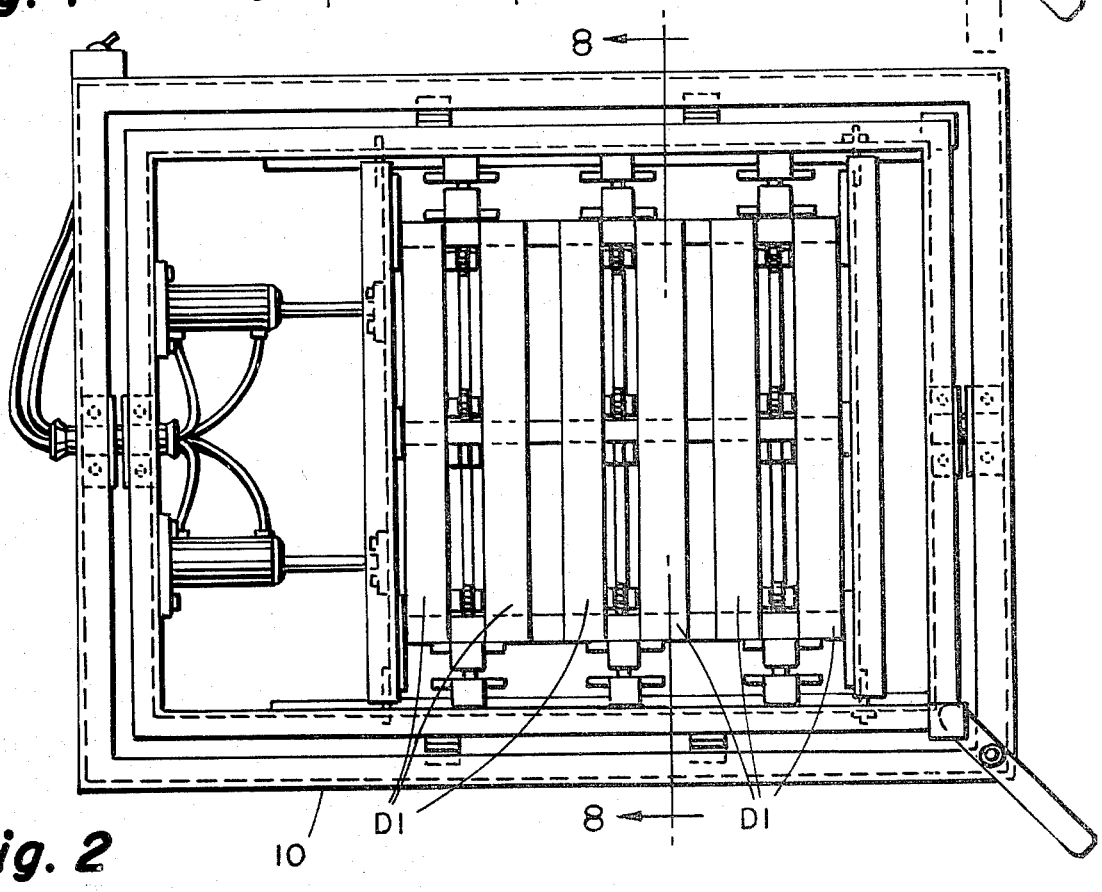
FIG. 2 is a view similar to FIG. 1 with the stringers and bottom deck boards placed in the apparatus.

Referring first to FIGS. 1, 2 and 3, the apparatus includes a main frame or base generally designated 10 and a cradle generally designated 11 which is mounted for rotation relative to the frame 10 along a horizontal axis 12.

In the illustrated embodiment, the frame 10 is formed in the form of a table, having four upright legs 13–16, and a rigid upper rectangular frame supported by and affixed to the legs, and including side members 17–20. Preferably, some means is provided for leveling the base 10. Persons skilled in the art will readily appreciate that the base 10 may be formed of sheet metal or other equivalent types of construction.

Figure 12:
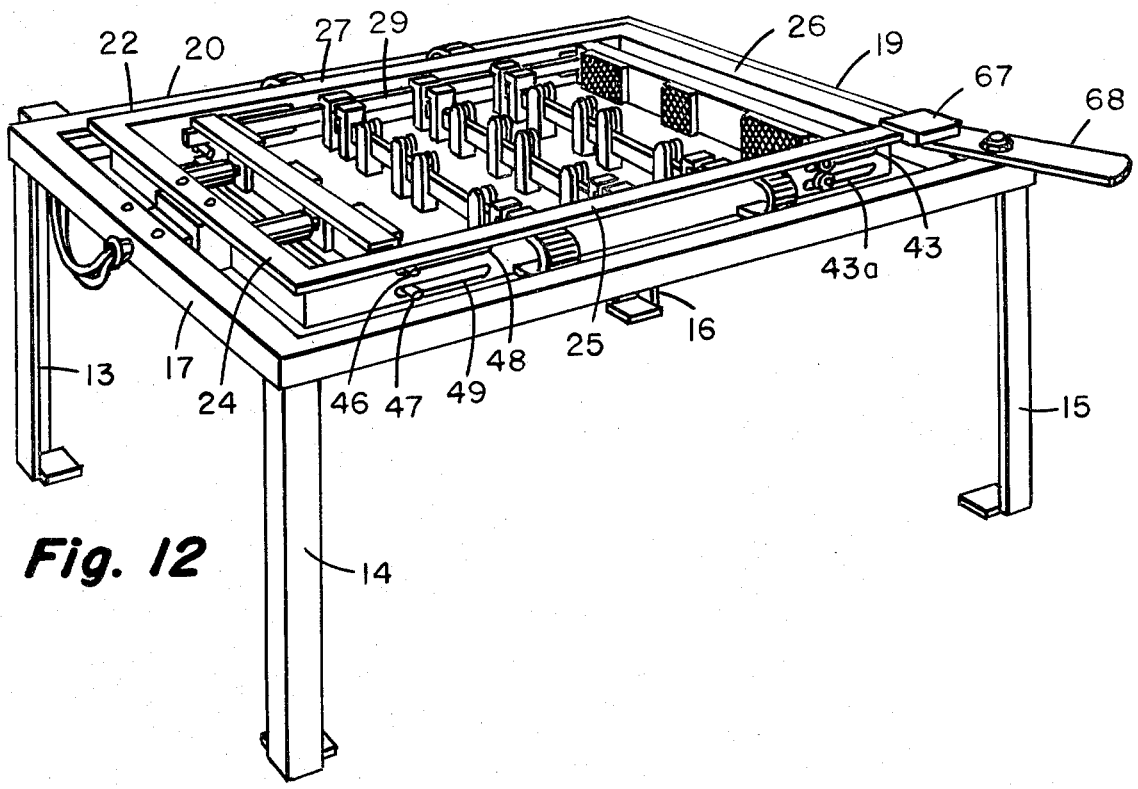
FIGS. 12–17 are perspective views of the apparatus illustrating a method of assembling a pallet using the apparatus.

Referring now to FIGS. 1, and 12, the cradle 11 includes a fabricated peripheral frame generally designated 22 which, in the illustrated embodiment, is made from C-shaped channel side members 24–27 rigidly connected together at their adjacent ends.

First and second longitudinal rails or tracks 28, 29 are welded or mounted respectively to the inner surfaces of opposing frame sides 25, 27.

Three longitudinal guide bars 30, 31 and 32 extend between the sides 25, 27 of the peripheral frame of the cradle, and they are releasably clamped to the rail 28 respectively by the clamps 33*a*, 33*b* and 33*c*. The guide bars 30–32 are similarly clamped to the rail 29 by similar clamps 33*d*, 33*e* and 33*f*. Spaced inwardly of the clamps 33*a*–33*c* are three additional, similar clamps designated respectively 33*g*–33*i*. Additional clamps 33*j*–33*l* are located at the other ends of the guide bars, spaced inwardly of the previously identified clamps 33*d*–33*f* respectively. The inner clamps 33*g*–33*l*, as will be described more fully below, are used when the deck boards are shorter than the guide bars, and they serve as end guides for the top deck boards (i.e. the second set applied) as well as outer side guides for the side stringers, as will be described presently. It will be observed, however, that the longitudinal guide bars 30–32 extend transverse of the axis of rotation 12.

Spaced inwardly of the deck board end guides 33*g*–33*i* on the guide bars are three stringer guides designated respectively 35*a*–35*c*. Similar stringer guides are located inboard of the deck board end guides 33*j*–33*l*, and these are designated 35*d*–35*f* respectively.

In the center of each guide bar, for the purpose of guiding the center stringer, there are a first set of three stringer guides 35*g*–35*i*, spaced to one side of the axis 12, and a second set of three, designated 35*j*–35*l* respectively, and again, mounted to the longitudinal guide bars 30–32 respectively. The end guides and clamps 33*a*–33*l* are shown in FIG. 10; the stringer guides 35*a*–35*l* are shown in FIG. 11. Both will be described in more detail below.

An end clamping bar designated 40 is fastened to the side members 25, 27 of the peripheral frame of the cradle. Preferably, the end clamp bar 40 may be adjusted along the axis 12 to accommodate pallets having different length (i.e. stringer sizes); and for this purpose, it is secured by end bolts 41, 42 and nuts. In the illustrated embodiment, the bolts are received in slots 43, 43*a* in the peripheral frame members 25, 27 (see FIGS. 12 and 13). The fixed end clamp 40 is seen in the extreme adjusted position at 41 in chain line.

In an alternative embodiment for a wider range of adjustment, the slots may be replaced by apertures spaced along a line parallel to axis 12. The spacing of the apertures in the peripheral frame for receiving the end clamp bar may be every two inches or so. Pallet lengths falling between these increments are accommodated by the motion of a movable clamp bar generally designated 44 which is slidably supported in the side frame members 25, 27 for clamping motion parallel to the axis 12 in clamping the stringers longitudinally against the fixed clamp bar 40, as will be described. The sliding clamp bar 44 has, at either end, a pair of nylon bushings (see those designated 46 and 47 in FIG. 12) which are received in longitudinal slots 48, 49 respectively in their associated peripheral side frame members for permitting sliding motion of the movable clamp bar 44 (alternatively, tracks may be used).

A pair of pneumatic cylinders 52, 53 are mounted to the end frame member 24 of the peripheral frame 11, and have their rods 55, 56 connected to the movable clamp bar 44 which is shown in solid line in FIG. 1 in the retracted position and in dashed line in the extended or clamping position at 44A.

The cradle 11 is mounted for rotation about the axis 12 by means of first and second pivot mounts generally designated 60 and 61. Each of these pivot mounts may be similar, and including, in the case of pivot mount 60, a stub shaft 63 secured to the frame 11 in the form of a round tubular member (to permit passage of the air hoses to the pneumatic cylinders) which is received in a bearing block 65 bolted to the end table frame member 17). Referring now to FIG 12, the cradle 11 has a limit position which is defined by a latch member 67 in the form of a plate welded to the frame which engages a latch 68, shown in the operative or locking position. Preferably, the latch 68 engages a recess in the latch member 67 to positively lock the cradle in the start position shown in FIG. 12; and a second latching member 67A (see FIG. 16) is provided on the lower end of the peripheral frame member 26 and on the opposite side thereof to lock the cradle in the discharge position shown in FIG. 17. Other positive locks may equally well be employed, and they may be pneumatically, electrically or manually operated. It is, however, preferable to provide a positive lock so that the cradle is not permitted to rotate when the pneumatic guns apply the nails, as will be described.

In order to positively and firmly clamp the stringers in place, the fixed clamp bar 40 and movable clamp bar 44, each has special gripper pads, two alternative forms being shown in FIGS. 4 and 5 respectively. In FIG. 4, a cross-serrated pattern is formed by casting or machining in a first clamp pad 70; and in FIG. 5, a spiked or nail plate generally designated 71 is secured to the clamp bar 44.

Referring to FIG. 6, the movable clamp bar 44 has two end gripper pads 73, 74 and a center gripper pad 75. The end gripper pads are wider than the center gripper pad 75 to accommodate adjustment of the side stringers to different size pallets. That is to say, in adjusting the width of a pallet (the width of a pallet being the dimension parallel to the deck boards), the side stringers are moved in equal amounts relative to the center line or axis of the center stringer. A similar gripper pad design is provided on the fixed clamp bar 40.

Referring now to FIG. 10, the structure of the end guide bar clamps 33*a*–33*f* and the deck board guides 33*g*–33*l* may be similar. That is, the same structure may perform both functions of securing the guide bars 30–32 to the longitudinal rails 28, 29, as well as providing a width adjustment for deck boards of different lengths. Turning then to the clamp generally designated 33 in FIG. 10, it includes a main body portion 80 in which a rectangular aperture 81 is formed. The aperture 81 receives one of the rectangular guide bars in a clearance fit. That is, it is only slightly larger than the dimension of the guide bar to permit it to be moved along the guide bar easily, but the tolerances are sufficiently close so that when the clamp is affixed to the guide bar, it does not rock. At one end of the body 80, there is a foot member 83 which is adapted to engage one side of one of the adjusting rails 28, 29 (see FIG. 7–9). Thus, the amount by which the foot 83 projects beyond the body 80 may be the same as the width of an associated rail.

The upper portion of the body 80 as seen in FIG. 10 is bored and tapped to receive a set screw 85. The set screw 85 extends at least partially into the aperture 81 to engage one of the guide bars in a clamping connection.

In the case of the end clamps (that is, where the function of the clamp 33 is to secure a guide bar (30, 32) to an adjusting rail 28, 29), the downward force of the screw 85 on the guide bar is opposed by the upward force of the bearing surface 83*a* of the foot member 83 on the rail thereby firmly holding the guide bar against the fixed rail (again, refer to FIGS. 7 and 8).

Extending laterally from the body 80 of the clamp 33 are a pair of wings designated 88, 89 respectively. As will be explained further below, the wings 88, 89 are placed at a location relative to the aperture 81 such as to define the positions of the deck boards on one side of the pallet when the cradle is in the discharge position. That is, the wings 88, 89 perform their function when the clamps 33 are used as deck board end guides, such as is shown at 33*g*–33*l*. In this position, the clamps 33 also serve as outer guides for the two side stringers, refer to strings S1 and S2 in FIG. 8, the outer surfaces of which are guided by clamp members 33*h* and 33*k* respectively.

Referring now to the stringer guides 35*a*–35*l*, they may also be similar except that the one set of stringer guides 35*g*–35*i* need not have a biasing spring as will be described. Referring then to FIG. 11, for the stringer guide generally designated 35, it includes a body portion 90 in which a central aperture 91 is formed to permit the guide to be adjusted along its associated guide bar. A screw 92 is threadedly received in the body 90 for clamping the guide against the bar in which it is received, similar to the manner in which the clamp 33 is secured to a guide bar.

The body portion 90 defines a pair of ears 93, 95 for receiving a coiled spring 96 which is mounted on a pin 97 staked or otherwise fastened to the ears 93, 95. The function of the spring 96 is to urge the stringer against one of the deck board end guides (33*g*–33*l*) or, in the case of the center stringer, to center it on the axis 12.

Referring now to FIG. 7, when the cradle 11 is in the start position, it will be observed that the deck board guide clamp 33*g* and the stringer guide 35*a* cooperate with the guide bar 30 to provide upwardly opening stringer guide means in the form of a channel or trough for receiving the stringer S1 (see FIG. 8). Similarly, the center stringer guides 35*g*, 35*j* define an upwardly opening guide, in cooperation with the guide bar 30 for receiving the central stringer S3. Similar structure receives the other side stringer S2, as seen in FIG. 8. This is important because when the cradle is turned to the discharge position, as seen in FIG. 9, the stringers (and completed pallet) are free to fall under gravity if they are not clamped longitudinally.

OPERATION AND METHOD

In order to adjust the machine to build a pallet of a given size and design, it is helpful to have one "pattern" pallet of that size and design to make the proper adjustment. To adjust the apparatus, two guide bars are inserted first, taking reference measurements from the fixed end (namely, fixed clamp bar 40). This pallet is then inserted into the cradle by turning the cradle to the start position and clamping the pallet in place. The cradle is then turned back to the discharge position, and the remaining guide bars are inserted to achieve proper spacing of what will eventually be the top deck boards of the pallet. The adjustable end clamp bar 40 must, of course, be fixed in place before the pattern pallet is clamped by actuating the pneumatic cylinders 52, 53. The various end clamps 33*a*–33*f* secure the guide bars to the rails 28, 29 in the manner described. If the desired pallet has a width less than the width of the cradle, the deck board end guides or clamps 33*g*–33*l* are then adjusted into place and clamped by means of the screws 85. The stringer guides are also slid along their associated guide bars until they engage the associated stringer on the pattern pallet, and they are fixed in place.

Figure 13:
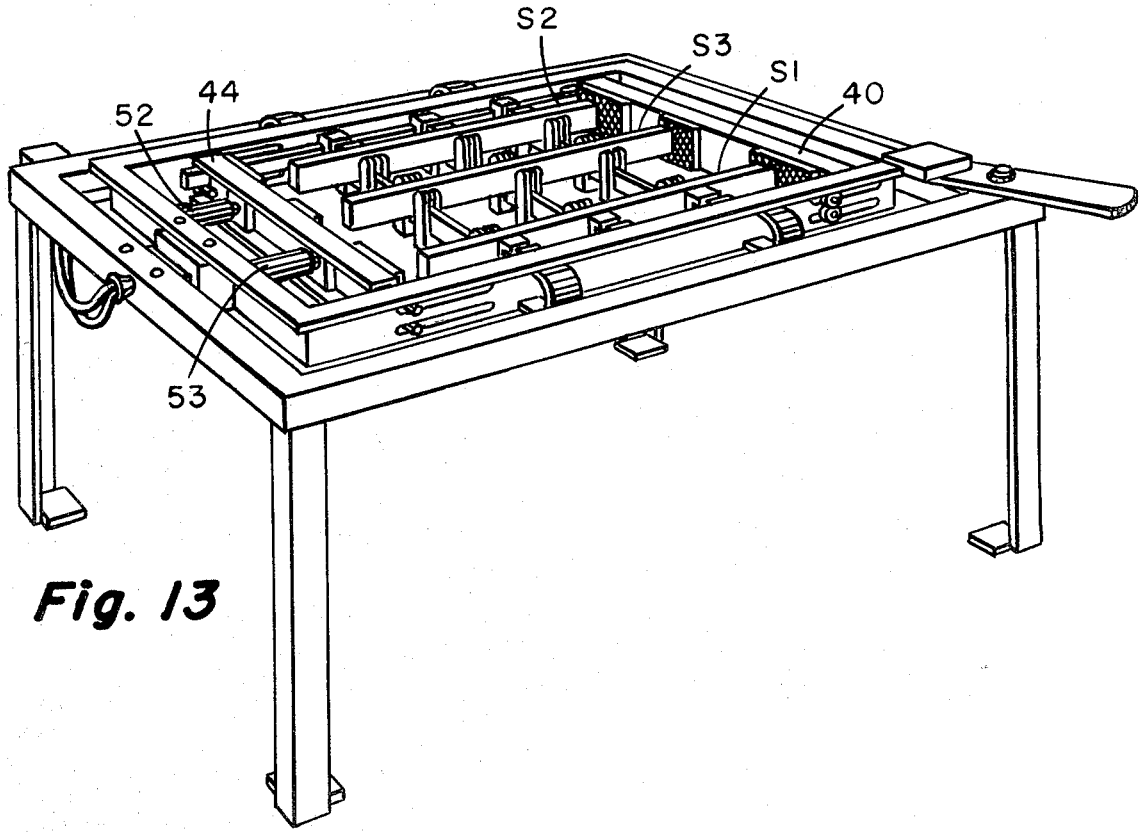
Figure 14:
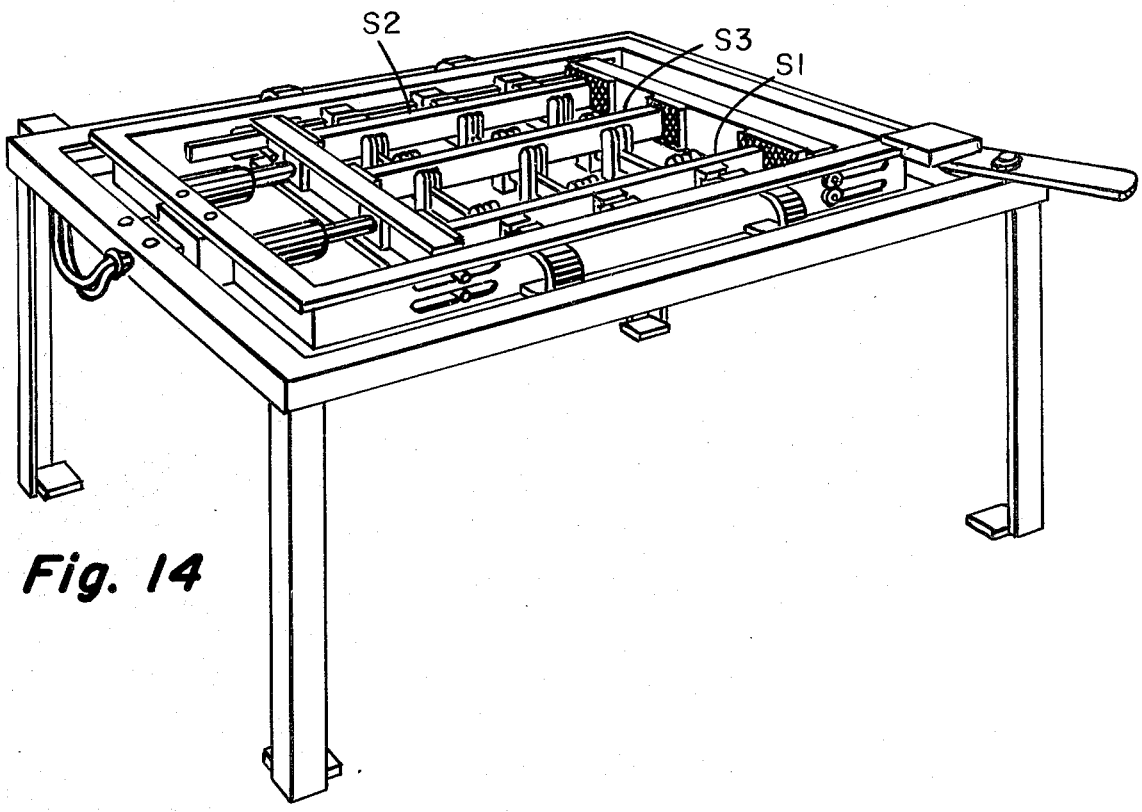

In operation, after the machine has been properly adjusted and the pattern pallet is removed, the cradle is turned to the start position shown in FIGS. 1 and 12, and with the clamp bar 44 retracted, the stringers are first inserted into the cradle as seen in FIGS. 8 and 13, while the cradle is locked. Next, the pneumatic cylinders 52, 53 are actuated to move the movable clamp bar 44 to engage the stringers with the gripper pads, and clamp them longitudinally, compare FIGS. 13 and 14. As mentioned before, before clamping, the stringers S1–S3 rest on the longitudinal guide bars 30–32.

Figure 15:
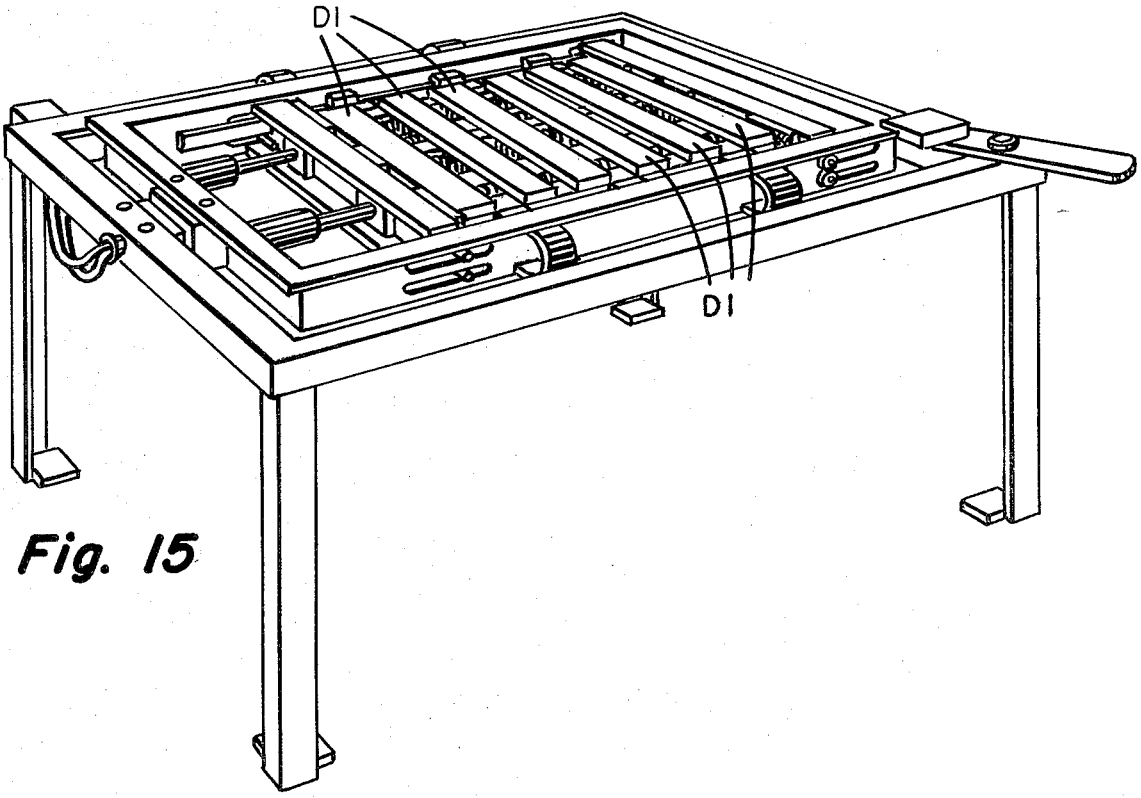

Next, one set of deck boards designated D1 in FIGS. 2, 8 and 15 are placed in position across the stringers. These deck boards will ultimately be the bottom deck boards of the pallet, and they are placed in location, guided by the side edges of the stringer and tape markings which may be applied to the cradle. The positioning of the lower deck boards usually is determined by notches in the stringers, in the case of a notched pallet, so this is not a critical operation.

The deck boards D1 are then fastened to the stringers, preferably using pneumatic hand guns driving twisted nails through the deck boards into the stringers in a conventional manner.

Figure 16:
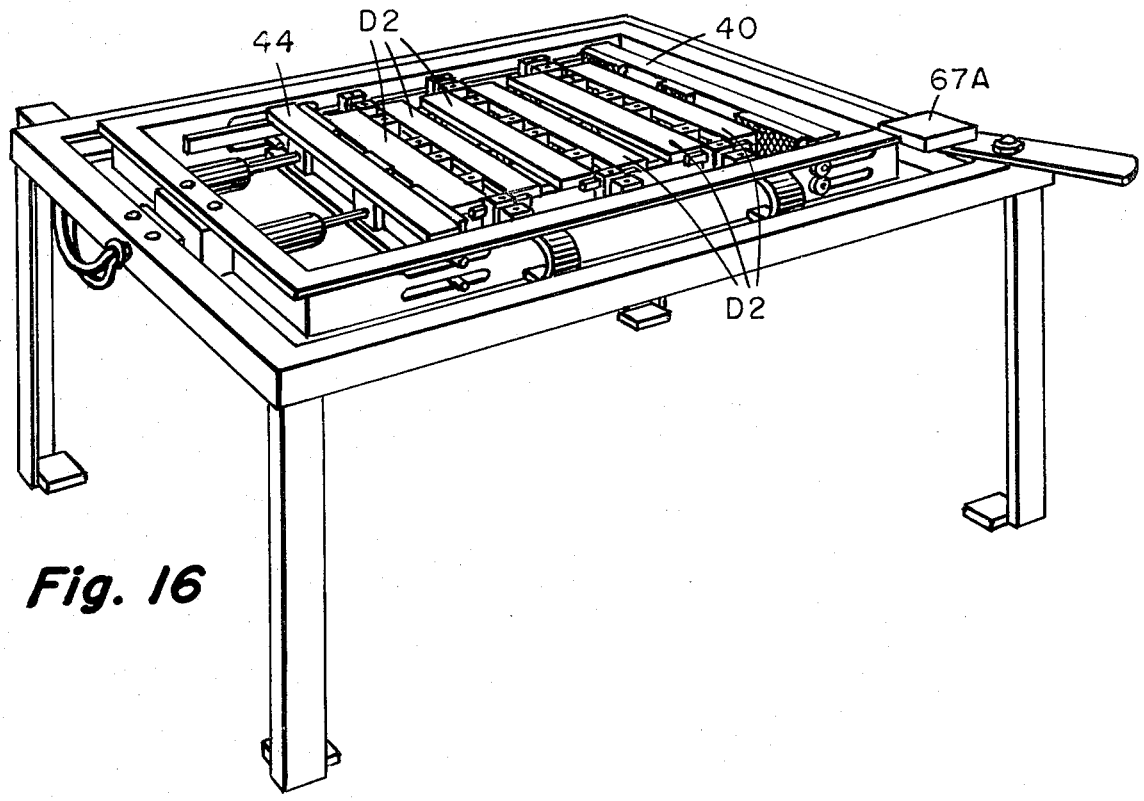

Next, the lock 67, 68 is unlatched, and the cradle is rotated in the direction of the arrow 103 in FIG. 3 a full 180° to the position shown in FIGS. 9 and 16, with the deck boards D1 facing downwardly. The second set of deck boards D2 are then placed in position, and these are guided by the clamps on the longitudinal guide bars 30–32. Preferably, the top deck boards in the center are placed in location and then slid by hand against one side guide. The end deck boards are placed in location and slid outwardly against the adjustable clamping bar 44 and fixed clamp bar 40 respectively.

The ends of the top deck boards are placed against the wings 88, 89 of the clamps 33g–33l, which will have been rotated toward the top of the cradle (see FIG. 9).

Figure 17:
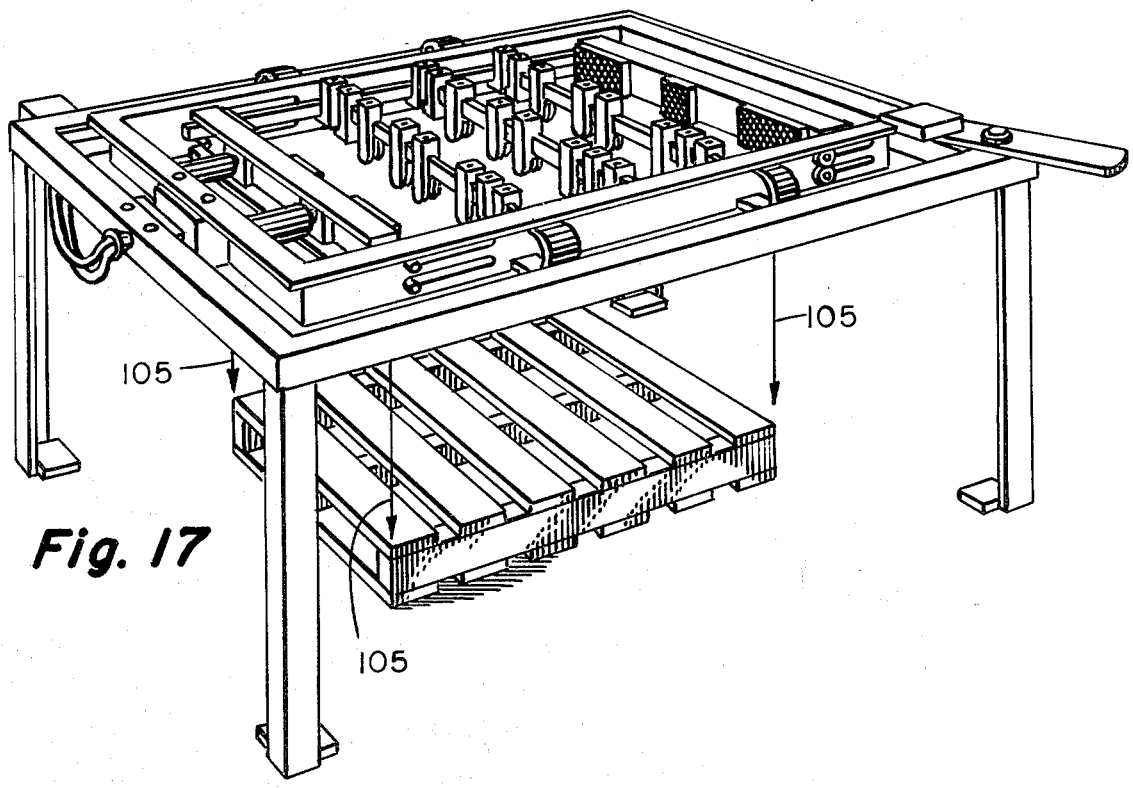

The top deck boards D2 are then fastened to the stringers, using the same hand guns. This completes the assembly of the pallet, and the pneumatic clamp is released, and the pallet falls free of the cradle under gravity in the direction of the arrows 105, as seen in FIG. 17. After the pallet is discharged (it may be removed from the discharge area by means of a driven conveyor or the like), the cradle is again unlatched and returned back to the start position for a new assembly cycle.

Having thus disclosed in detail a preferred embodiment of the invention, persons skilled in the art will be able to modify the structure which has been illustrated as well as the steps disclosed, and to substitute equivalent elements for those described, while continuing to practice the principle of the invention; and it is, therefore, intended that all such modifications and substitutions be covered as they are embraced within the spirit and scope of the appended claims.

I claim:

1. Apparatus for assembling pallets comprising: a base; a cradle mounted to said base for rotary motion about a horizontal axis between a start and a discharge position; longitudinal guide means mounted to said cradle and extending between opposite sides thereof; stringer guide means carried by said longitudinal guide means and opening upwardly to receive a plurality of stringers in spaced, parallel relation when said cradle is in said start position; actuatable clamp means for clamping said stringers in said stringer guide means, whereby a first set of deck boards may be fastened to said stringers while said cradle is in said start position and said stringers are held by said clamp means, and a second set of deck boards may be fastened to the other side of said stringers when said cradle is rotated to said discharge position and a completed pallet may be discharged under gravity when said clamp means is released.

2. The apparatus of claim 1 wherein said cradle includes a peripheral frame symmetrical about its axis of rotation between said start and discharge positions, and wherein said longitudinal guide means include a plurality of elongated bars in spaced, parallel relationship; and means for securing opposite ends of said guide bars to opposite sides of said peripheral cradle frame.

3. The apparatus of claim 2 further comprising first and second elongated tracks extending longitudinally of opposite sides of said peripheral cradle frame and wherein said securing means include releasable clamp means for releasably securing said guide bars in adjusted positions along said tracks.

4. The apparatus of claim 2 wherein said clamp means includes a fixed clamp bar extending transverse of pallet stringers received in said cradle, a movable clamp bar extending parallel to said fixed clamp bar and mounted to said cradle frame for motion parallel to the direction of elongation of stringers received therein; and power means for selectively moving said movable clamp bar into clamping relation with said stringers.

5. The apparatus of claim 2 further comprising adjustable end guides for said second set of deckboards, adjustably mounted to said bars.

6. The apparatus of claim 1 further comprising means for selectively locking said cradle in said start position and in said discharge position.

7. Apparatus for assembling pallets each having a plurality of stringers, a first set of deck boards on one side of said stringers and a second set of boards on the other side of said stringers, comprising: a base; a cradle mounted to said base for rotational motion about an axis parallel to the direction of elongation of said stringers and passing between said sets of deck boards when assembled to said stringers, whereby said cradle may be rotated approximately 180° between a start and a discharge position without being translated substantially; longitudinal guide means mounted to said cradle and extending between opposite sides thereof; stringer guide means carried by said longitudinal guide means to receive a plurality of stringers in spaced, parallel relation when said cradle is in said start position; actuatable clamp means for clamping said stringers endwise in said stringer guide means, whereby one of said sets of boards may be fastened to said stringers while said cradle is in said start position and said stringers are held by said clamp means, and the other of said sets of boards may be fastened to the other side of said stringers when said cradle is rotated to said discharge position and a completed pallet may be discharged away from the operator when said clamp means is released.

* * * * *